US007621268B2

(12) United States Patent
Junck

(10) Patent No.: US 7,621,268 B2
(45) Date of Patent: Nov. 24, 2009

(54) LOW PHYSIOLOGICAL DEADSPACE SNORKEL

(76) Inventor: Anthony D. Junck, 2069 Hawkinson Rd., Oregon, WI (US) 53575-2313

( * ) Notice: Subject to any disclaimer, the term of this patent is extended or adjusted under 35 U.S.C. 154(b) by 967 days.

(21) Appl. No.: 10/988,888

(22) Filed: Nov. 15, 2004

(65) Prior Publication Data

US 2006/0102176 A1 May 18, 2006

(51) Int. Cl.
*B63C 11/02* (2006.01)
*B63C 11/00* (2006.01)
*B63C 11/16* (2006.01)
*A62B 18/08* (2006.01)

(52) U.S. Cl. ..... 128/201.27; 128/201.26; 128/201.11; 405/186; 405/187

(58) Field of Classification Search ..... 128/201.11, 128/201.27, 207.14, 207.16, 200.29, 200.15, 128/201.28, 911, 202.27, 205.24, 206.26; 137/512; 405/186, 187
See application file for complete search history.

(56) References Cited

U.S. PATENT DOCUMENTS 1,946,126 A * 2/1934 Black ..... 128/201.11
2,317,237 A 4/1943 Wilen
2,780,224 A 2/1957 Wallace
2,815,751 A * 12/1957 Ferraro ..... 137/410
2,865,369 A * 12/1958 Kline ..... 128/207.16
2,975,439 A * 3/1961 Bentley ..... 128/201.11
3,166,083 A * 1/1965 Girden ..... 137/388
3,370,586 A * 2/1968 Aragona et al. ..... 128/201.11
3,860,042 A 1/1975 Green
4,061,140 A * 12/1977 Saito ..... 128/201.11
4,071,024 A 1/1978 Blanc
4,278,080 A 7/1981 Schuch
4,610,246 A * 9/1986 Delphia ..... 128/201.11
4,655,212 A 4/1987 Delphia
4,793,341 A * 12/1988 Arasmith ..... 128/201.11
4,805,610 A * 2/1989 Hunt ..... 128/201.11
4,860,739 A * 8/1989 Vandepol ..... 128/201.11

(Continued)

FOREIGN PATENT DOCUMENTS

JP 408048291 A * 2/1996

(Continued)

OTHER PUBLICATIONS

Riffe Snorkel "The Stable" web page printout http://www.speargun.com/new.htm# May 27, 2004.

*Primary Examiner*—Justine R Yu
*Assistant Examiner*—Annette F Dixon
(74) *Attorney, Agent, or Firm*—Stiennon & Stiennon

(57) ABSTRACT

A snorkel has an inhalation tube and a check valve near a mouthpiece which allows air to flow toward the mouthpiece, and a float valve which closes the inhalation tube. An exhalation tube has a second check valve also located near the mouthpiece which only allows air to flow into the exhalation tube. The snorkel has a purge valve positioned below the mouthpiece. A further check valve is positioned between the inhalation tube and the exhalation tube to allow air or water in the exhalation tube to pass to the inhalation tube placed as close to the first check valve as possible. The exhalation tube outlet orifice may be closed by a simple gravity actuated valve which will float open during a dive. Alternatively the exhalation tube outlet orifice may be closed by a float valve.

22 Claims, 1 Drawing Sheet

U.S. PATENT DOCUMENTS

| | | | | | |
|---|---|---|---|---|---|
| 4,872,453 | A | * | 10/1989 | Christianson | 128/201.11 |
| 4,877,022 | A | | 10/1989 | Christianson | |
| 4,896,664 | A | | 1/1990 | Harayama | |
| 5,117,817 | A | | 6/1992 | Lin | |
| 5,143,059 | A | * | 9/1992 | Delphia | 128/201.11 |
| 5,239,990 | A | * | 8/1993 | Delphia | 128/201.11 |
| 5,413,059 | A | * | 5/1995 | Schips | 112/308 |
| 5,664,558 | A | | 9/1997 | Wagner | |
| 5,868,129 | A | * | 2/1999 | Christianson | 128/201.11 |
| 5,893,362 | A | * | 4/1999 | Evans | 128/201.11 |
| 5,937,850 | A | * | 8/1999 | Kawashima et al. | 128/201.11 |
| 6,119,685 | A | * | 9/2000 | Kawashima et al. | 128/201.11 |
| 6,295,983 | B1 | * | 10/2001 | Semeia | 128/201.11 |
| 6,302,102 | B1 | | 10/2001 | Giroux et al. | |
| 6,318,363 | B1 | * | 11/2001 | Monnich | 128/201.11 |
| 6,516,897 | B2 | * | 2/2003 | Thompson | 175/19 |
| 6,550,479 | B1 | * | 4/2003 | Duxbury | 128/205.27 |
| 6,655,378 | B2 | * | 12/2003 | Swetish | 128/201.11 |
| 6,668,822 | B2 | | 12/2003 | Monnich | |
| 6,668,823 | B1 | | 12/2003 | Liu | |
| 6,679,253 | B1 | * | 1/2004 | Feng | 128/201.11 |
| 6,904,910 | B2 | * | 6/2005 | Christianson | 128/201.11 |
| 6,971,386 | B2 | * | 12/2005 | Duxbury | 128/205.27 |
| 7,032,591 | B2 | * | 4/2006 | Monnich | 128/201.11 |
| 7,047,965 | B1 | * | 5/2006 | Ball | 128/201.11 |
| 7,077,127 | B2 | * | 7/2006 | Christianson | 128/201.11 |
| 7,163,012 | B2 | * | 1/2007 | Delphia | 128/201.11 |
| 2002/0026939 | A1 | * | 3/2002 | Silvestri | 128/201.11 |
| 2002/0088460 | A1 | * | 7/2002 | Monnich | 128/201.11 |
| 2002/0135380 | A1 | * | 9/2002 | Estelle | 324/525 |
| 2003/0029448 | A1 | * | 2/2003 | Swetish | 128/201.11 |
| 2003/0047182 | A1 | * | 3/2003 | Chen-Lieh | 128/201.11 |
| 2003/0121547 | A1 | * | 7/2003 | Aucoin | 137/388 |
| 2004/0035414 | A1 | * | 2/2004 | Johnson | 128/200.29 |
| 2004/0211413 | A1 | * | 10/2004 | Monnich | 128/201.11 |
| 2005/0188986 | A1 | * | 9/2005 | Christianson | 128/201.11 |
| 2006/0102176 | A1 | * | 5/2006 | Junck | 128/201.11 |
| 2006/0185667 | A1 | * | 8/2006 | Delphia | 128/201.11 |
| 2006/0254582 | A1 | * | 11/2006 | Christianson | 128/201.11 |
| 2006/0272637 | A1 | * | 12/2006 | Johnson | 128/201.27 |

FOREIGN PATENT DOCUMENTS

| | | | | |
|---|---|---|---|---|
| JP | 2002154480 | A | * | 5/2002 |
| WO | WO 9109772 | A1 | * | 7/1991 |

* cited by examiner

Float Valve
32
Float Valve
66
34
72
68
64
22
48
Mouthpiece
74
70
26
54

44
32
42
30
46
42
38
40
37
20
60
34
58
56
36
28
22
52
48
24
50
78
82
84
62
80
26
76
54

LOW PHYSIOLOGICAL DEADSPACE SNORKEL

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to snorkels, used for snorkeling and free diving, in general, and to snorkels having an inhalation tube and an exhalation tube in particular.

The snorkel as an aid to swimming and diving has been known from ancient times. Archimedes mentions an instrument for respiration which he compared to the trunk of an elephant. It appears that the Chinese used snorkels with curved tubes around 340 A.D. Leonardo da Vinci in his codex "Atlanticus" illustrated improved snorkel designs. The forerunners of the modern snorkel appeared among French spear fishermen around 1930.

The snorkel provides the ability to look downwardly into the water while breathing air from the surface. The snorkel also allows a swimmer to breathe without raising his head above the water surface, thereby reducing energy used by lifting the head above the water surface. The snorkel is also a considerable aid to free divers i.e. divers without a supplemental supply of air such as provided by a scuba tank. To understand the use of a snorkel it is necessary to consider respiration, the process whereby oxygen is supplied to the tissues of a person to sustain life. The amount of oxygen necessary to support a human depends on the level of physical activity, varying from about 300 ml per minute for a person at rest, to about 3,500 ml per minute for a person doing heavy labor. In order to maximize the amount of time which the breath can be held during a free dive, divers endeavor to lower the carbon dioxide level in the lungs and in the blood. High concentrations of carbon dioxide in the blood trigger the impulse to breathe. On the other hand, low concentrations of oxygen in the blood do not trigger the impulse to breathe, but can cause loss of consciousness. Therefore if a free diver extends the length of time during which he can hold his breath, by blowing off carbon dioxide, it is very important that physical activity be minimized to avoid exhausting the oxygen available to remain conscious.

When a person is at rest, and therefore using the minimal amount of oxygen, the amount of air inhaled and exhaled, i.e. the tidal volume, is only about 500 ml, although the typical total lung capacity is 46 liters. Of this tidal volume, approximately 150 ml is so-called "physiological dead space" i.e. air remaining in the nasal and bronchial passages which does not exchange oxygen with the blood. The 150 ml anatomical dead space amounts to about 30 percent of the total tidal volume. A typical snorkel adds a dead space of 100 to 200 ml, raising the total dead space to 50 to 70 percent of the at-rest tidal volume. This means the snorkeler must breathe more deeply than when at-rest, deep breathing in turn increases the aerobic activity, which produces fatigue and increases oxygen consumption. Increased oxygen consumption reduces the safe permissible dive time. What is needed is a snorkel with decreased dead space which functions well during free diving.

SUMMARY OF THE INVENTION

The snorkel of this invention employees two tubes which extend from a mouthpiece to above the surface of the water. One of the tubes is an inhalation tube incorporating a check valve near the mouthpiece which only allows air to flow toward the mouthpiece. The inhalation tube has an intake orifice with a float valve which closes the air intake orifice when the intake orifice is submerged, either momentarily by a wave or when the snorkeler dives. The second tube which extends from the mouthpiece is an exhalation tube and incorporates a second check valve also located near the mouthpiece which only allows air to flow into the exhalation tube from the mouthpiece. In this way the snorkel substantially eliminates the dead airspace, and therefore allows the a swimmer to maintain an at rest breathing pattern with a normal tidal volume. The snorkel also incorporates a purge valve positioned below the mouthpiece for purging residual water from the snorkel.

To prevent collapse of the snorkel during a dive where water pressure may increase 15 to 20 psi, it is necessary to either fill the snorkel with expired air, or with water from the surrounding body of water. However, the inhalation tube is sealed off by the first check valve and the float valve from any source of air or water. Therefore if a snorkel is to be used for diving, a further check valve is positioned between the inhalation tube and the exhalation tube to allow air or water in the exhalation tube to pass to the inhalation tube. The further check valve will preferably be placed as close to the first and second check valves as possible, and in this position a strong exhalation through the snorkel will cause air to move through the inhalation tube via the further check valve purging water from the inhalation tube. To avoid having to breathe into the snorkel while diving, to prevent snorkel collapse, the exhalation tube outlet orifice may be closed by a simple gravity actuated flapper valve which will float open during a dive, allowing water to enter the exhalation tube, and from the exhalation tube enter the inhalation tube through the further check valve. Alteratively, the exhalation tube outlet orifice may be closed by a float valve in which case exhalation air is needed to prevent collapse, or water must be allowed to enter the snorkel through the mouthpiece.

It is a feature of the present invention to provide a snorkel which substantially eliminates physiological dead space within the snorkel.

It is another feature of the present invention to provide a snorkel which is less fatiguing to use.

It is a further feature of the present invention to provide a snorkel whose user will consume less oxygen.

It is a yet further feature of the present invention to provide a snorkel which does not collapse while diving.

It is a still further feature of the present invention to provide a snorkel which has two tubes and reduced hydrodynamic drag.

Further objects, features and advantages of the invention will be apparent from the following detailed description when taken in conjunction with the accompanying drawings.

DESCRIPTION OF THE PREFERRED EMBODIMENTS

Figures 1, 2:
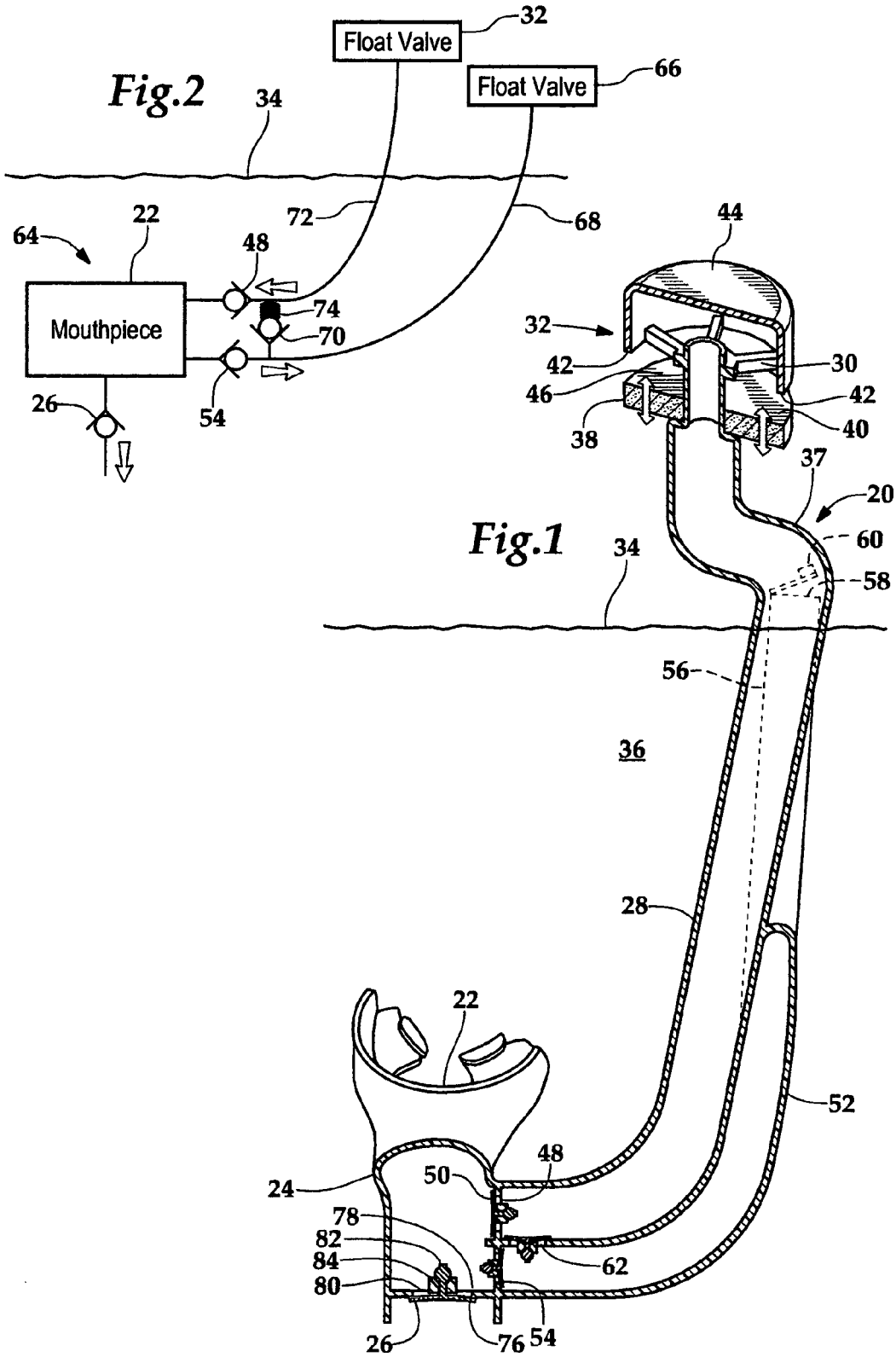
FIG. 1 is a cross-sectional, partially isometric, view of the snorkel of this invention.
FIG. 2 is a schematic view of an alternative embodiment of the snorkel of FIG. 1.

Referring more particularly to FIGS. 1-2, wherein like numbers refer to similar parts, a snorkel 20 is shown in FIG. 1. The snorkel 20 has a mouthpiece 22 which fits within a diver's mouth and through which the diver can inhale and exhale air. The mouthpiece 22 is an upward extension of a mouthpiece body 24 which extends downwardly to a purge valve 26. The purge valve 26 incorporates a check valve to allow water to be removed from the mouthpiece body 24 and to keep water from entering the mouthpiece body. An inhalation tube 28 extends from the mouthpiece body 24. The inhalation tube 28 extends laterally and upwardly to an air inlet orifice 30 which extends above the surface 34 of a body of water 36. The inhalation tube 28 may a bent section 37 to position the inlet orifice 30 over a snorkeler's head, The inlet orifice 30 is closed by a float valve 32 having a washer-shaped float 38, which has an upper surface 40 which seals against a downwardly facing lip 42 surrounding a cap structure 44. The float 38 encircles a narrow section 46 of the inhalation tube 28, riding upwardly on the narrow section 46 due to the buoyant effect of water, when the float 38 is submerged.

An inhalation check valve 48 is positioned where the inhalation tube 28 joins the mouthpiece body 24, or immediately adjacent to the mouthpiece body 24 to minimize the amount of dead air within the snorkel 20. The check valve 48 has a valve member 50 of flexible sealing material and which allows air only to travel out of the inhalation tube 28 into the mouthpiece 24.

When the diver exhales through the mouthpiece 22 air travels through an exhalation tube 52. The exhalation tube 52 is smaller in diameter, and thus smaller in cross-sectional area, and shorter in length than the inhalation tube 28. An exhalation check valve 54 is positioned where the exhalation tube 52 joins the mouthpiece body 24, or immediately adjacent thereto. The exhalation check valve 54 operates in the direction opposite to the inhalation check valve 48 allowing air from the mouthpiece only to enter the exhalation tube 52. The exhalation tube 52 extends along the inhalation tube 28 starting below the inhalation tube and extending to the posterior side 56 of the inhalation tube as the inhalation tube and the exhalation tube extend upwardly to the water surface 34, as shown in figure FIG. 2. The exhalation tube 52 terminates in an air outlet orifice 58 which incorporates a gravity operated valve 60 which closes the outlet orifice 58 to prevent water from splashing into the exhalation tube, but which opens when air is exhausted or when the snorkel is completely submerged. Opening of the valve 60 allows water to flood the exhalation tube 52 and pass through a third check valve 62 to the inhalation tube 28, and from the inhalation tube to the mouthpiece body 24.

An alternative embodiment snorkel 64 is shown schematically in FIG. 2, which also illustrates schematically the operation of the snorkel 20. The alternative embodiment snorkel 64 differs from the snorkel 20 in that the air outlet orifice incorporates not a gravity operated valve but a second float valve 66. The float valve 66 may be advantageous where the snorkel is not used for free diving below a few feet, and keeping the snorkel dry is more of a concern than preventing snorkel collapse. In any event, snorkel collapse can be prevented by removal of the mouthpiece 22 from the diver's mouth, so the water may flood the exhalation tube 68 and from the exhalation tube pass through a check valve 70 to the inhalation tube 72 which may be held closed by a spring 74 as illustrated in FIG. 2. The spring 74 should be understood to be a symbolic representation of the various approaches which could be used to bias the valve 70 closed. Such approaches might include a resilient valve closing member, a magnetically biased valve, or a lightweight leaf or coil spring. If the snorkel 64 is used only when near the surface, the valve 70 may not even be necessary.

It should be understood that the float valves 32, 66 could be of any design now existing or later developed including those where the float moves vertically, and where the float causes a horizontal motion to close an air intake. The gravity operated valve 60 should also be understood to not be limited to the valve illustrated but to include other types of gravity activated valves such as, but not limited to, a ball in a cage, where the ball is less dense than water. The gravity operated valve may also cause either vertical or horizontal motion to close a horizontal or vertical exhalation air outlet.

It should be understood that a portion of the inhalation tube, and exhalation tube could be rendered flexible by any means known or later developed, for example by a tube of flexible rubber or plastic which is supported against collapse by a series of spaced rings or thick sections. The mouthpiece could also be pivotable on the mouthpiece body so the mouthpiece can be most easily placed in the mouth. It should also be understood that the shape of the inhalation and exhalation tubes may be of various configurations, and the tubes may be combined into a single structure which is partitioned to form the tubes.

Further it should be understood that the snorkel 20 could function without a purge valve 26 wherein water is cleared through the exhalation tube 52. The check valves 26, 54, 62, 48, will preferably be as illustrated in FIG. 1, referring by way of example to check valve 26 the valve has an elastic member 76, placed over a valve seat 78. A radial extending structure 80 supports the valve member 76, and a central elastic portion 82 of the valve member extends through a central boss 84 supported by the radially extending structure 80. It should be understood that check valves of other designs could be used.

It is understood that the invention is not limited to the particular construction and arrangement of parts herein illustrated and described, but embraces all such modified forms thereof as come within the scope of the following claims.

I claim:

1. An improved snorkel used as a swimming aid, of the type with decreased dead space which facilitates free diving having:

a mouthpiece;

an inhalation tube of a first cross-sectional area, connected to the mouthpiece, and extending upwardly of the mouthpiece a first distance, the inhalation tube terminating in a float valve;

a first check valve positioned between the inhalation tube and the mouthpiece, the first check valve arranged to allow air to be drawn through the float valve to the mouthpiece but prevents air flowing from the mouthpiece through the first check valve to the inhalation tube;

an exhalation tube of a second cross-sectional area, the exhalation tube extending upwardly of the mouthpiece along and joined to the inhalation tube a second distance which is less than the first distance, the exhalation tube being terminated by an exhalation valve;

a second check valve positioned between the exhalation tube and the mouthpiece, the second check valve arranged to allow air to be exhausted from the mouthpiece through the exhalation tube but prevents air from being drawn through the exhalation tube to the mouthpiece; and a purge valve which incorporates a check valve positioned below the mouthpiece;

wherein the improvement comprising:

wherein the exhalation tube of the second cross-sectional area being smaller than the first cross-sectional area of the inhalation tube;

wherein the purge valve which incorporates the check valve positioned below the mouthpiece is positioned before the second check valve;

wherein the exhalation valve is a gravity operated valve which prevents water from entering when the exhalation valve is above a water surface, but opens when the exhalation valve is below the water surface.

2. The snorkel of claim 1 wherein the exhalation valve which terminates the exhalation tube is a float valve which seals the exhalation tube when the exhalation valve is submerged.

3. The snorkel of claim 1 wherein the exhalation tube starts below the inhalation tube and extends upwardly posteriorly of the inhalation tube to the exhalation valve.

4. The snorkel of claim 1 further comprising a third check valve between the exhalation tube and the inhalation tube and positioned closely spaced from the first check valve, the third check valve allowing water or air to flow from the exhalation tube into the inhalation tube.

5. The snorkel of claim 4 wherein the third check valve is biased in a closed position by a spring.

6. An improved snorkel used as a swimming aid of the type with decreased dead space which facilitates free diving having:

a mouthpiece;

an inhalation tube of a first cross-sectional area, connected to the mouthpiece, and extending upwardly of the mouthpiece a first distance, the inhalation tube terminating in a float valve;

a first check valve positioned between the inhalation tube and the mouthpiece, the first check valve arranged to allow air to be drawn through the float valve to the mouthpiece but prevents air flowing from the mouthpiece through the first check valve to the inhalation tube;

an exhalation tube, of a second cross-sectional area extending upwardly of the mouthpiece along the inhalation tube a second distance which is less than the first distance, the exhalation tube terminating in an exhalation valve;

a second check valve positioned between the exhalation tube and the mouthpiece, the second check valve arranged to allow air to be exhausted from the mouthpiece through the exhalation tube but which prevents air from being drawn through the exhalation tube to the mouthpiece; and a third check valve positioned to connect the exhalation tube and the inhalation tube, the third check valve closely spaced from the first check valve;

wherein the improvement comprising:

wherein the exhalation tube of the second cross-sectional area being smaller than the first cross-sectional area of the inhalation tube;

wherein the third check valve is mounted to allow water or air to flow from the exhalation tube into the inhalation tube;

wherein the exhalation valve is a gravity operated valve which prevents water from entering when the second valve is above a water surface, but opens when the exhalation valve is below the water surface.

7. The snorkel of claim 6 wherein the exhalation valve is a float valve which seals the exhalation tube when the exhalation valve is submerged.

8. The snorkel of chum 6 wherein the exhalation tube starts below the inhalation tube and extends upwardly posteriorly of the inhalation tube to the exhalation valve.

9. The snorkel of chum 6 further comprising a purge valve which incorporates a check valve positioned below the mouthpiece and before the second check valve.

10. The snorkel of claim 6 wherein the third check valve is biased in a closed position by a spring.

11. An improved snorkel used as a swimming aid of the type with decreased dead space which facilitates free diving having:

a mouthpiece;

an inhalation tube of a first cross-sectional area, connected to the mouthpiece, and extending upwardly of the mouthpiece a first distance;

a first check valve positioned between the inhalation tube and the mouthpiece, the first check valve arranged to allow air to be drawn through the inhalation tube to the mouthpiece but which prevents air flowing from the mouthpiece through the first check valve to the inhalation tube;

an exhalation tube of a second cross-sectional areas, and extending upwardly of the mouthpiece along the inhalation tube a second distance less than the first distance;

a second check valve positioned between the exhalation tube and the mouthpiece, the second check valve arranged to allow air to be exhausted from the mouthpiece through the exhalation tube but which prevents air from being drawn through the exhalation tube to the mouthpiece; and a third check valve positioned to connect the exhalation tube and the inhalation tube, the third check valve closely spaced from the first check valve;

wherein the improvement comprising:

wherein the exhalation tube of the second cross-sectional area being smaller than the first cross-sectional area of the inhalation tube;

wherein the third check valve is mounted to allow water or air to flow from the exhalation tube into the inhalation tube;

wherein a gravity operated valve is mounted to the exhalation tube, the gravity operated valve preventing water from entering the exhalation tube when it is above a water surface, and the gravity operated valve letting water enter the exhalation tube when the gravity operated valve is below the water surface.

12. The snorkel of claim 11 further comprising a purge valve which incorporates a check valve positioned below the mouthpiece, and before the second check valve.

13. The snorkel of claim 11 wherein a float valve is mounted to the exhalation tube and is positioned to seal the exhalation tube when the exhalation tube is submerged.

14. The snorkel of claim 11 wherein the inhalation tube terminates at an inhalation end and a float valve is mounted to the inhalation end and is positioned to seal the inhalation tube when the inhalation tube is submerged.

15. The snorkel of claim 11 wherein the exhalation tube starts below the inhalation tube and extends upwardly posteriorly of the inhalation tube.

16. The snorkel of claim 11 wherein the third check valve is biased in a closed position by a spring.

17. An improved snorkel for use as a swimming aid of the type with decreased dead space which facilitates free diving having:

a mouthpiece;

an inhalation tube connected to the mouthpiece and extending laterally and upwardly of the mouthpiece to an air inlet orifice;

a first check valve positioned between the inhalation tube and the mouthpiece, the first check valve arranged to allow air to be drawn through the inhalation tube to the mouthpiece but which prevents air flowing from the mouthpiece through the first check valve to the inhalation tube;

an exhalation tube, connected to the mouthpiece, and extending laterally and upwardly of the mouthpiece along and joined to the inhalation tube to an air outlet orifice;

a second check valve positioned between the exhalation tube and the mouthpiece, the second check valve arranged to allow air to be exhausted from the mouthpiece through the exhalation tube but prevents air from being drawn through the exhalation tube to the mouthpiece; and a third check valve positioned to connect the exhalation tube and the inhalation tube, the third check valve closely spaced from the first check valve;

wherein the improvement comprising:

wherein the third check valve allowing water or air to flow from the exhalation tube into the inhalation tube;

wherein a gravity operated valve is mounted to the exhalation tube, the gravity operated valve preventing water from entering the exhalation tube when it is above a water surface, and the gravity operated valve letting water enter the exhalation tube when the gravity operated valve is below the water surface.

18. The snorkel of claim 17 further comprising a purge valve which incorporates a check valve positioned below the mouthpiece and before the second check valve.

19. The snorkel of claim 17 wherein a float valve is mounted to the exhalation tube and is positioned to seal the exhalation tube when the exhalation tube is submerged.

20. The snorkel of claim 17 wherein a float valve is mounted to the inhalation tube and is positioned to seal the inhalation tube when the inhalation tube is submerged.

21. The snorkel of claim 17 wherein the exhalation tube starts below the inhalation tube and extends upwardly posteriorly of the inhalation tube.

22. The snorkel of claim 17 wherein the third check valve is biased in a closed position by a spring.

* * * * *

UNITED STATES PATENT AND TRADEMARK OFFICE

CERTIFICATE OF CORRECTION

PATENT NO. : 7,621,268 B2
APPLICATION NO. : 10/988888
DATED : November 24, 2009
INVENTOR(S) : Anthony D. Junck It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1403 days.

Signed and Sealed this

Twenty-sixth Day of October, 2010

David J. Kappos

David J. Kappos
*Director of the United States Patent and Trademark Office*